US011122857B2

(12) United States Patent
Cass

(10) Patent No.: US 11,122,857 B2
(45) Date of Patent: Sep. 21, 2021

(54) FOOTWEAR CUSHIONING SOLE ASSEMBLY

(71) Applicant: Wolverine Outdoors, Inc., Rockford, MI (US)

(72) Inventor: William J. Cass, Belmont, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 196 days.

(21) Appl. No.: 16/439,091

(22) Filed: Jun. 12, 2019

(65) Prior Publication Data

US 2020/0390188 A1 Dec. 17, 2020

(51) Int. Cl.
*A43B 13/12* (2006.01)
*A43B 13/18* (2006.01)
*A43B 13/22* (2006.01)

(52) U.S. Cl.
CPC ..... *A43B 13/125* (2013.01); *A43B 13/184* (2013.01); *A43B 13/223* (2013.01)

(58) Field of Classification Search
CPC ... A43B 13/125; A43B 13/184; A43B 13/223; A43B 13/127; A43B 13/146; A43B 13/181; A43B 7/06
See application file for complete search history.

(56) References Cited

U.S. PATENT DOCUMENTS 3,172,217 A 3/1965 Colman
4,236,326 A * 12/1980 Inohara ..... A43B 13/181 36/29
5,775,005 A 7/1998 McClelland
6,065,229 A * 5/2000 Wahrheit ..... A43B 13/00 36/25 R
D490,596 S 6/2004 Belley et al.
D502,595 S 3/2005 Sonnergren
D504,758 S 5/2005 Sonnergren
D509,345 S 9/2005 Munns
D515,290 S 2/2006 Sonnergren
D518,280 S 4/2006 Matis et al.
D530,891 S 10/2006 Matis et al.
D537,611 S 3/2007 Matis et al.
(Continued)

FOREIGN PATENT DOCUMENTS

CH 715590 A1 * 5/2020 ..... A43B 13/186
FR 2684525 A1 * 6/1993 ..... A43B 7/082

*Primary Examiner* — Alissa L Hoey
*Assistant Examiner* — Patrick J. Lynch
(74) *Attorney, Agent, or Firm* — Warner Norcross + Judd LLP

(57) ABSTRACT

A footwear construction includes a sole assembly having a first midsole platform of a first durometer and a second midsole platform of a second durometer, less than the first, so that the second midsole platform is softer than the first, and an outsole having an outsole upstanding cup wall surrounding the second midsole platform so as to protect it from abrasion, and to control a lateral and expansive movement of the softer second midsole platform, when lugs of the outsole are pushed upward toward the second midsole platform due to lug engagement with an underfoot terrain feature. The platforms can be constructed from a different durometer EVA or foam. The first durometer can be about 50-60 Asker C, inclusive and the second durometer can be about 35-45 Asker C, inclusive.

20 Claims, 6 Drawing Sheets

(56) References Cited

U.S. PATENT DOCUMENTS

| | | | | |
|---|---|---|---|---|
| 2004/0134097 | A1* | 7/2004 | Russell | A43B 13/185 36/29 |
| 2005/0034328 | A1* | 2/2005 | Geer | A43B 13/10 36/30 R |
| 2008/0289215 | A1* | 11/2008 | Park | A43B 13/28 36/28 |
| 2008/0295361 | A1* | 12/2008 | Johnson | A43B 21/26 36/103 |
| 2010/0031530 | A1* | 2/2010 | Abshire | A43B 13/181 36/28 |
| 2012/0180335 | A1* | 7/2012 | Mahoney | A43B 13/141 36/28 |
| 2012/0297641 | A1* | 11/2012 | Pfister | A43B 7/223 36/43 |
| 2013/0318828 | A1* | 12/2013 | Sink | A43B 13/181 36/103 |
| 2014/0202031 | A1* | 7/2014 | Seo | A43B 13/026 36/28 |
| 2014/0250720 | A1* | 9/2014 | Miner | A43B 13/20 36/29 |
| 2014/0259746 | A1* | 9/2014 | Abshire | A43B 13/185 36/29 |
| 2014/0331517 | A1* | 11/2014 | Seo | A43B 13/20 36/28 |
| 2015/0082668 | A1* | 3/2015 | Nonogawa | A43B 13/16 36/30 R |
| 2019/0082781 | A1* | 3/2019 | Iuchi | A43B 13/04 |
| 2019/0216169 | A1* | 7/2019 | Yahata | A43B 13/18 |
| 2019/0231026 | A1* | 8/2019 | Fujita | A43B 7/32 |
| 2020/0093218 | A1* | 3/2020 | Kajiwara | A43B 13/127 |
| 2020/0305545 | A1* | 10/2020 | Yahata | A43B 13/146 |

* cited by examiner

FOOTWEAR CUSHIONING SOLE ASSEMBLY

BACKGROUND OF THE INVENTION

The present invention relates to footwear, and more particularly to footwear having a sole assembly with a cushioning system that works with an outsole to provide a unique underfoot feel and enhanced traction.

There is a variety of different types of sole assemblies used in conjunction with footwear. Many sole assemblies include a midsole constructed from foam, and an underlying outsole, usually constructed from rubber for durability. The foam provides underfoot cushion, and the outsole can include lugs for traction. The foam typically is rather uniform throughout the midsole, but can be formed in varying thicknesses to conform to the bottom of a user's foot, or to provide more cushion in the heel and less in the forefoot to assist in cushion and maintain a proper gait.

Most foam midsoles also are of a solid core layer of the same material throughout. Such a construction adds some rigidity to the midsole, which can be helpful where both support and rigidity are desired. However, in some cases, such rigidity can affect traction. For example, as mentioned above, the outsole under the midsole can include lugs. When those lugs encounter an underfoot obstacle or terrain feature, the lug is placed under a force that urges the lug upward, toward the midsole. The midsole foam, when of a uniform material, provides an opposing force to the force on the lug. In turn, the lug is left to engage and bite the terrain feature or obstacle itself, without the midsole contributing to that function. In addition, if too rigid a foam is selected for the midsole, that foam as mentioned above can impair deflection of the lugs, and potentially decrease the traction of the lugs on some surfaces and features.

Accordingly, there remains room for improvement in the construction of sole assemblies to assist in making midsoles and outsoles cooperatively work together to provide enhanced traction yet preserve cushion in the footwear.

SUMMARY OF THE INVENTION

Footwear is provided including a sole assembly having a structural midsole platform disposed above a traction enhancing midsole platform that selectively absorbs lugs from an arrangement of lugs disposed on an outsole under the traction enhancing midsole platform, to thereby enhance traction of the sole assembly on underfoot terrain features.

In one embodiment, the sole assembly includes a first midsole platform of a first durometer and a second midsole platform of a second durometer, less than the first, so that the second midsole platform is softer than the first.

In another embodiment, the sole assembly include an outsole having an outsole upstanding cup wall surrounding the second midsole platform so as to protect it from abrasion, wear and damage. The upstanding cup wall also can be configured to control a lateral and expansive movement of the softer second midsole platform, when lugs of the outsole are pushed upward toward the second midsole platform due to lug engagement with an underfoot terrain feature.

In still another embodiment, the first and second midsole platforms can be constructed from closed cell foam. The first midsole platform can have a first durometer of about 50 to 60 Asker C, inclusive. The second midsole platform can have a second durometer of about 35-45 Asker C, inclusive.

In yet another embodiment, the first midsole platform can include a first upward extending cup wall that extends upward from a first upper surface to conceal a lower portion of the upper. The first midsole platform can include a first lower surface opposite the first upper surface that is bonded to an upper surface of the second midsole platform.

In even another embodiment, the second midsole platform can include a second sidewall that transitions between a second upper surface and a second lower surface. The second upper surface can define multiple of recesses arranged in an array. The array can include multiple pillar walls, with respective upper pillar surfaces bonded to the first lower surface of the first midsole platform.

In a further embodiment, the outsole base can be flexible so that certain ones of the lugs of the outsole can collapse upwardly into a respective recess of the multiple recesses defined by the second midsole platform, when those lugs engage an underfoot terrain feature. Other lugs, however, can be compressed between the underfoot terrain feature and a pillar wall above those other lugs when those lugs engage the underfoot terrain feature. The underfoot terrain feature can be absorbed at least partially via the lugs of the outsole interfacing with the second midsole platform to thereby enhance traction of the footwear.

The present footwear construction provides benefits in cushioning, traction and underfoot feel that previously have not been achievable. The midsole cushioning system, when including different durometer platforms, can enable the sole assembly to conform around underfoot terrain features, rather than merely reacting to those features. The outsole and midsole can provide support to protect the foot, yet can be supple enough to interact with the variety of underfoot terrain features. Where the lower, second midsole platform is an extremely low durometer cushioning platform, its soft material, for example, foam, can be shielded by an outsole cup wall so as to protect that material from abrasion and wear. Where included, that outsole cup wall also can control the lateral and expansive movement of the softer material. Where the upper surface of the second midsole platform includes an array or grid of recesses, the lugs on the outsole can misalign or align with those recesses to provide either normal response cushioning or a softer cushioning where the lug lines up with a recess. These components can be combined and tuned with other sole assembly components to change the characteristics and performance of the footwear.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
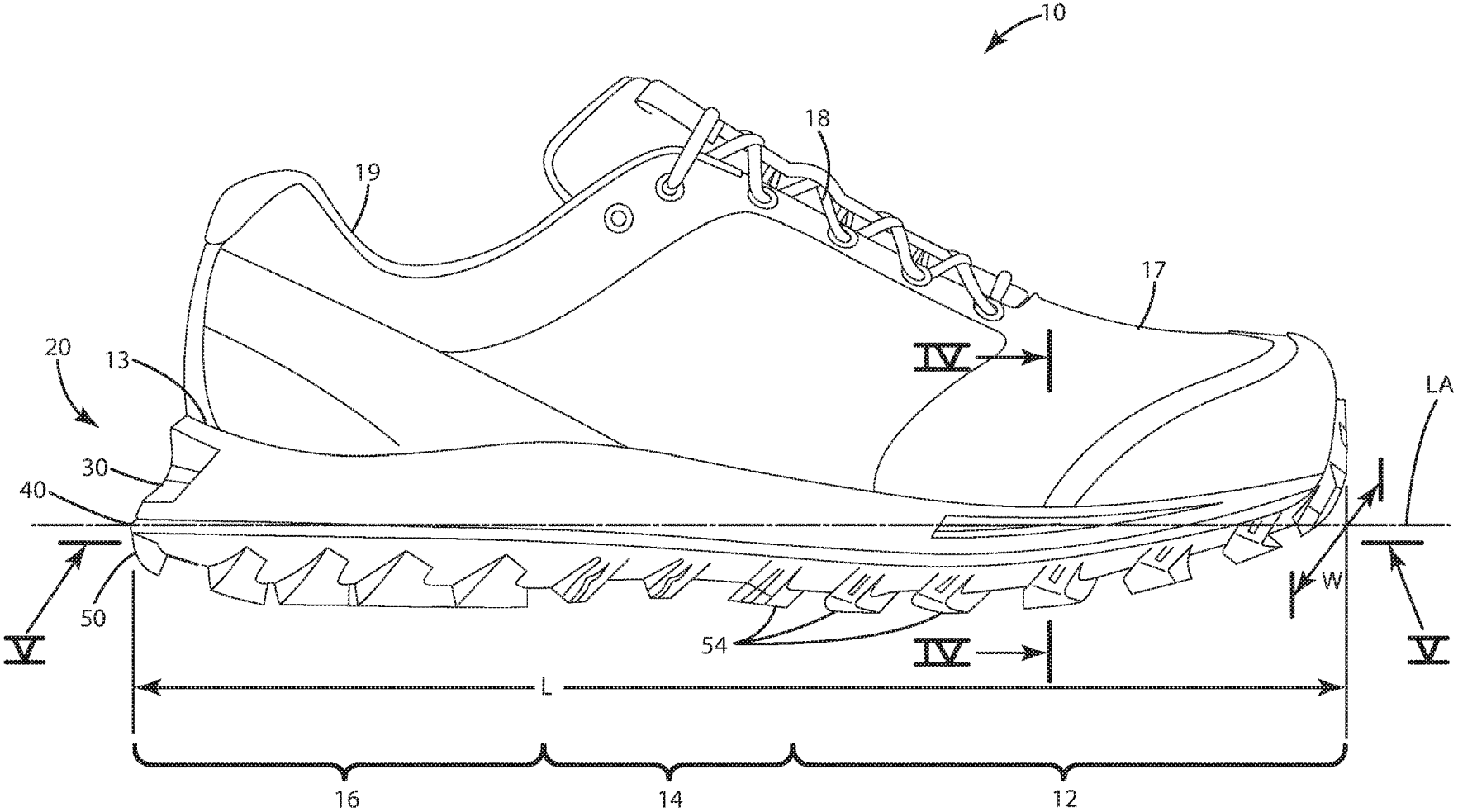
FIG. 1 is a side view of footwear of a current embodiment illustrating the sole assembly, and exposed first and second midsole platforms.

A current embodiment of the footwear is illustrated in FIGS. 1-5 and generally designated 10. In this embodiment, the footwear includes a sole assembly 20 including a first midsole platform 30, a softer second midsole platform 40 defining multiple impact absorbing and traction enhancing recesses 60, and an outsole 50 having multiple independent lugs 54 that can cooperate with the softer midsole platform to enhance traction as well as underfoot cushion.

Although the current embodiment is illustrated in the context of a hiking shoe, they may be incorporated into any type or style of footwear, including performance shoes, trail shoes and boots, work boots, all-terrain shoes, running shoes, athletic shoes, running shoes, sneakers, conventional tennis shoes, walking shoes, multisport footwear, casual shoes, dress shoes or any other type of footwear or footwear components. Generally, the shoe is well suited for rough uneven terrain having a variety of different types of underfoot features that may engage the footwear. The sole assembly herein can provide lugs on a flexible outsole and a softer midsole platform above those lugs that operate in concert to provide a stable footing and to absorb underfoot terrain features to enhance traction. This can provide reactive and dynamic traction to the sole assembly and footwear, thus enabling the wearer to have confidence in their footing, even on very uneven and unstable surfaces.

It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 12, arch region or mid-foot region 14, and heel region 16 generally are identified in FIG. 1. However, it is to be understood that delineation of these regions may vary depending upon the configuration of the sole assembly and/or footwear.

Figure 2:
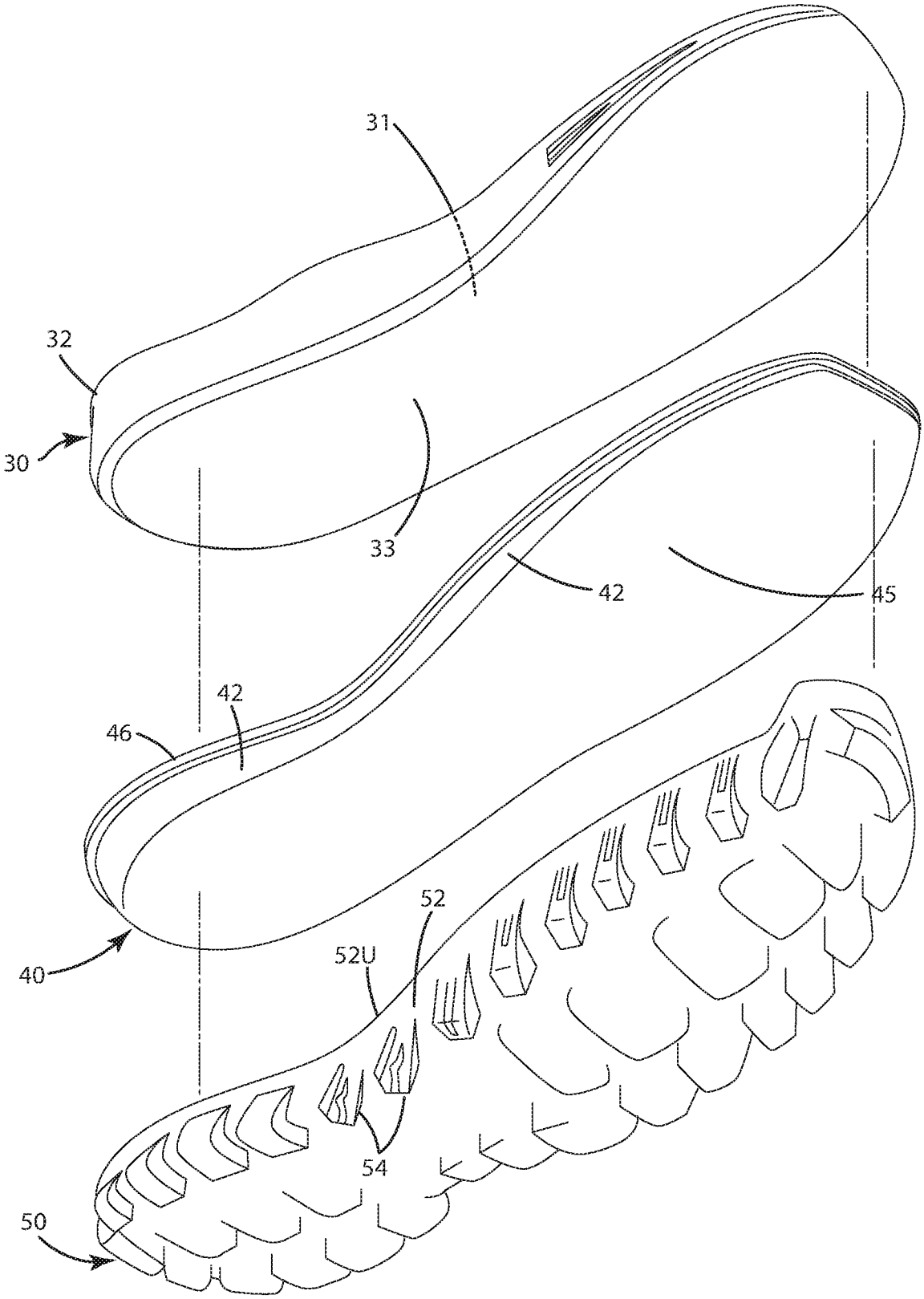
FIG. 2 is a bottom exploded view of the sole assembly.

With reference to FIGS. 1-2, the footwear 10 can include a sole assembly 20. The sole assembly 20 can include a first midsole platform 30, a second midsole platform 40, and an outsole 50, also referred to as an outsole tread herein. The lowermost or ground contacting surfaces of the outsole tread, can include multiple lugs 54, treads, spikes, cleats and/or other features designed to enhance traction between the footwear and an underlying surface. More or fewer elements of the sole assembly 20 can be included in some embodiments. The components of the sole assembly can individually and/or collectively provide the article of footwear 10 with a number of attributes, such as support, rigidity, flexibility, stability, cushioning, comfort, reduced weight, and/or other attributes. Generally, regardless of which components are present, the sole assembly 20 can form the bottommost portion of the footwear 10. The sole assembly 20 can include a side-to-side width W, a heel-to-toe longitudinal length L and a longitudinal axis LA, which can be shared with the footwear, sole assembly, first and second midsole platforms, and/or the outsole.

The footwear 10 can include a textile upper 17 joined with the sole assembly 20. The upper 17 can be formed from a variety of material elements joined together to cover at least a portion of the wearer's foot. The material elements can be selected based on the intended uses of the article of footwear 10, and can include synthetic textiles, mesh textiles, polymers or leather, for example. The upper 17 can be constructed to improve the rigidity of the sole assembly 20. For example, the upper can be constructed from leather, plastic, canvas or other materials. The upper 17 can include one or more closure elements, including for example shoelaces 18. The upper 17 additionally includes an upper opening 19 for receiving the wearer's foot and a lower periphery 13 for attachment to the sole assembly 20.

A footbed (not shown) can be positioned within the void defined by the upper and can be non-stretchable and lightweight and joined to the upper to provide a void for receipt of the wearer's foot. The footbed can be constructed from a sheet of material, such as foam, EVA, PU, latex, gel or other materials, and by virtue of its compressibility, provide cushioning, and may also conform to the foot in order to provide comfort, support, and stability. The lower peripheral allowance or edge of the upper can be stitched, cemented, or otherwise fastened to the footbed around the perimeter of the footbed. The sole assembly 20 can be combined with any other type or style of upper construction capable of being suitably joined with the outsole 50, for example a Strobel construction. The joining of the sole assembly/outsole and the upper can be accomplished using adhesives, cement, injection molding, pour molding or any other technique used to join an upper and sole assembly.

With reference to FIGS. 2-6, the sole assembly 20 components will now be described in further detail. As mentioned above, the sole assembly 20 can include the outsole 50, as well as one or more midsole platforms, for example, a first midsole platform 30 and a second midsole platform 40 disposed, between the upper 17 and the outsole 50. The first midsole platform 30 can include a first upper surface 31 that is generally in the shape of the upper and is configured to outline a wearer's foot. The first upper surface 31 can be bounded at least partially by first upstanding midsole wall 32. This first upstanding midsole wall 32 can extend from the toe to the heel, becoming generally greater in height H1 as it extends toward the heel region. In the heel region, the wall 32 can form a heel cup to add stability to the upper 17 and a wearer's heel when positioned in the upper. The first upstanding midsole wall 32 also can extend upwardly adjacent a lower peripheral allowance 17A of the upper 17, at least partially concealing that lower peripheral allowance 17A or lower portion of the upper 17. The upstanding midsole wall 32 can approximate a shape of a wearer's foot. A first lower surface 33 can be disposed opposite the first upper surface 31. This first lower surface 33 can be substantially flat and/or planar across a majority of the width W of the sole assembly. Near its edges, this flat planar surface 33, can transition to optional shoulders 34A and 34B. These optional shoulders then can transition upward to the first upstanding midsole wall 32 on opposing sides of the width W, for example, on the lateral and medial sides of the sole assembly and footwear.

The first midsole platform 30 optionally can be constructed from ethyl vinyl acetate (EVA), polyurethane (PU), latex, foam, a gel or other materials. As shown, the first midsole platform 30 can be constructed from EVA to provide cushion and impact absorption. However, this midsole platform or layer of the midsole can be of a hardness or durometer that is selected to provide synergistic functionality with the second midsole platform laying below the first midsole platform. For example, the first midsole platform 30 can be constructed from a first material, such as a EVA or foam padding having a durometer of optionally about 50 Asker C to about 60 Asker C, inclusive further optionally about 48 Asker C to about 65 Asker C, inclusive, and even further optionally about 55 Asker C. Such a harder, higher durometer material has more wear resistance it is able to add more stability to the upper and thus the wearer's foot, particularly via the first upstanding midsole wall 32 and the heel cup formed in the heel by that wall. Due to its higher durometer, however, this first midsole platform is rather rigid, but still provide some level of cushioning. It also does not deform as well as the optionally lower durometer material of the second midsole platform 40 as described below.

The first and second midsole platforms can cooperate with one another, one providing the rigidity, the other providing enhanced impact absorption and deformation ability, to improve traction as described further below.

Figure 4:
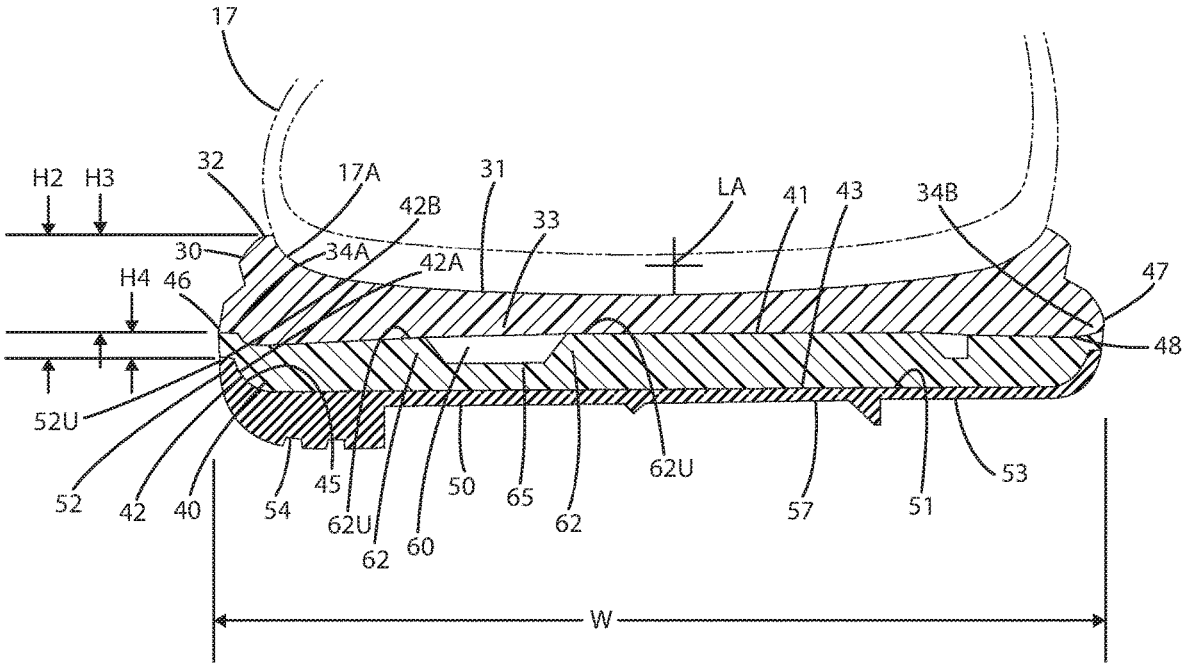
FIG. 4 is a cross section of the sole assembly of the footwear along line IV-IV of FIG. 1.
Figure 5:
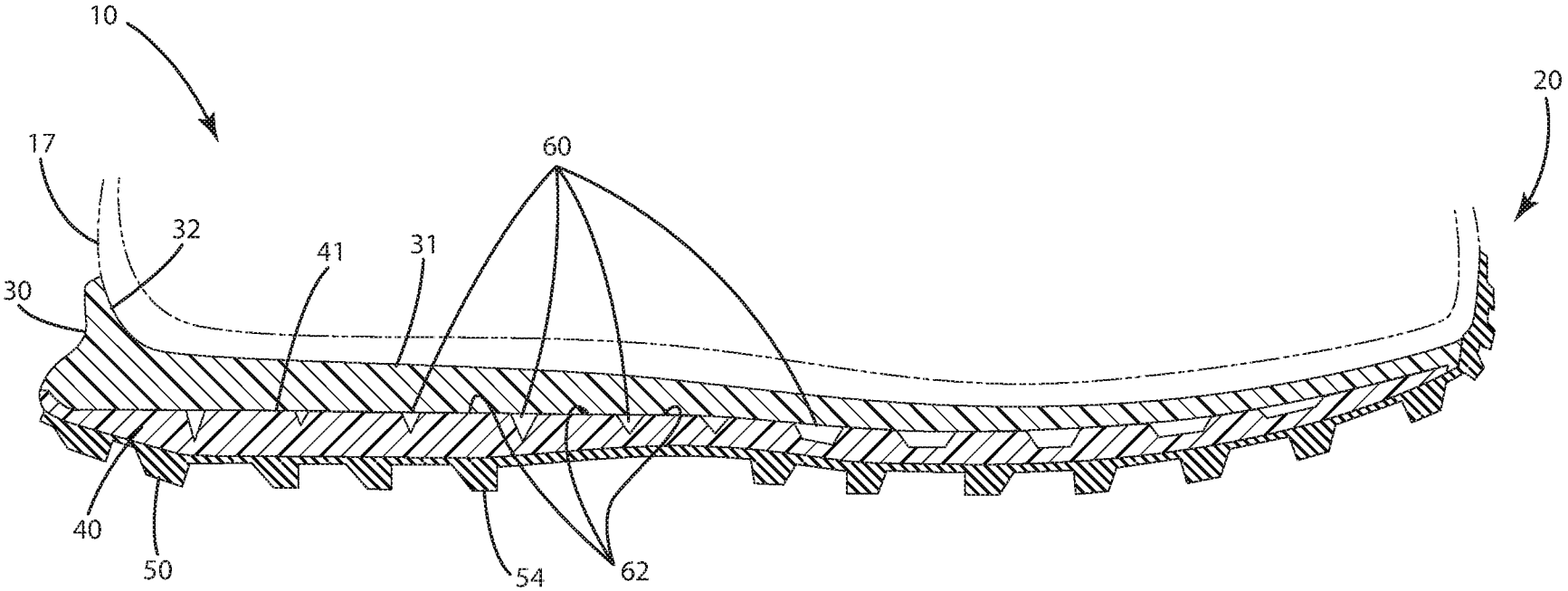
FIG. 5 is a cross section of the sole assembly of the footwear along line V-V of FIG. 1.

It is noted that the exterior portion of the first upstanding midsole wall 32 also can be exposed to the environment for a majority of the midsole height H2 shown in FIG. 4. The midsole platform 30 there and its midsole wall 32 are shown exposed to the environment a height H3. In contrast, the second midsole platform 40 is exposed to the environment only for a height H4, which is a small fraction of the overall height H2 of the midsole exposed to the environment. By exposed to the environment is meant that the particular material or component is visible to a viewer of the footwear from a side view, front view, heel view or rear view of the footwear. Generally, the more exposure to the environment, the higher the likelihood a component will be engaged with objects and/or other terrain features. In such case, the engaged component can be abraded and/or damaged. As described further below, the lower durometer second midsole platform 40 can be more prone to abrasion and wear, or otherwise damaged, when exposed to the environment. Thus, the sole assembly components can be arranged so as to shield and protect the second midsole platform 40 from the environment, while still allowing it to be utilized as a cushioning and traction enhancing component of the assembly. A portion of that second midsole platform also can be exposed to the environment to show a consumer that that cushioning and or traction enhancing component is present. In some cases, the material of the second midsole platform can be a contrasting color and/or reflectance so as to better show the consumer that it is present in the sole assembly.

Turning now to the second midsole platform 40, that component can include a second upper surface 41 and a second lower surface 43 opposite the second upper surface. The second midsole platform 40 can include a second sidewall 42 that extends generally upward from the second lower surface 43 toward the second upper surface 41. Near the second lower surface 43, the second midsole platform can include a second radiused corner 45. As shown, for example, in FIG. 4, this radiused corner 45 can be rather rounded and not forming a typical squared off corner that is the junction of two planes. Of course, in other optional constructions, this is exactly what how this radiused corner can be formed. The second midsole sidewall 42 can extend upward, toward the second upper surface 41.

Optionally, a portion of the second midsole platform 40 can be exposed. This portion can be part of the second sidewall 42. This portion of the sidewall can be exposed a height H4, which optionally can be 0.5 mm-5.0 mm, inclusive; 1.0 mm-2.5 mm, inclusive; or 1.0 mm. Generally, this height can be selected so that not much of the soft material from which the second midsole platform and sidewall are constructed is exposed to the environment, to thereby protect a majority of the sidewall. In some cases, the second sidewall 42 can include an outwardly extending flange 46. This outward extending flange can fit at least partially within a portion of the shoulder 34A of the first midsole platform 30 disposed above the second midsole platform 40. Where the outsole 50 includes an upstanding cup wall 52, that upstanding cup wall can include an upper edge 52U. The outward extending flange 46 can extend adjacent and over the upper edge 52U, away from a longitudinal axis LA. Generally, this outward extending flange 46 can be the portion of the second sidewall 42 that is exposed between the first upstanding midsole sidewall 32 and the outstanding outsole upstanding cup wall 52. Optionally, the second radiused corner 45 as described above can be disposed below the upper edge 52U of the outsole upstanding cup wall, and also below the outward extending flange, as well as the upper surface 41 of the second midsole platform 40.

Figure 3:
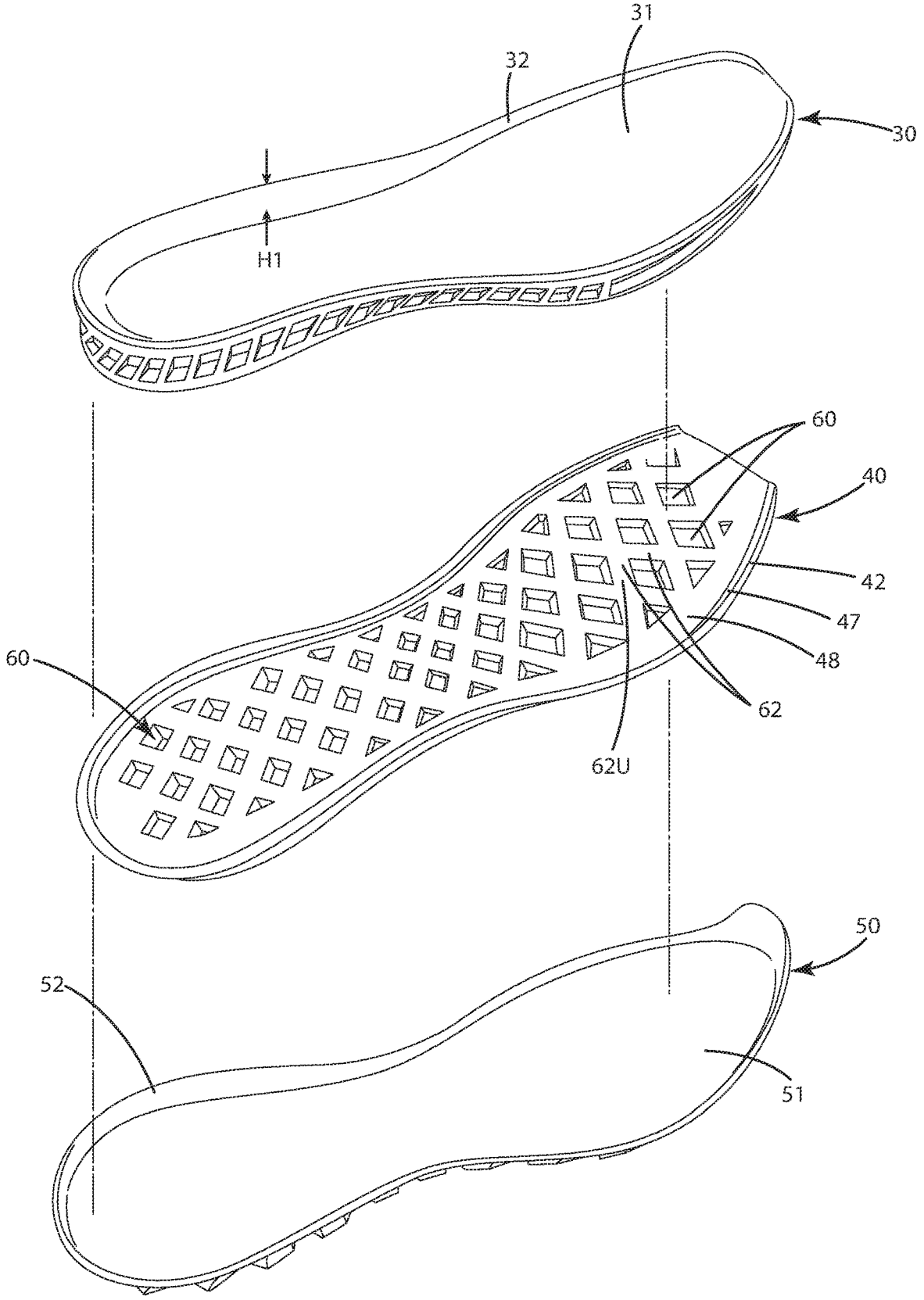
FIG. 3 is a top exploded view of the sole assembly, showing the soft second midsole platform with an array of multiple recesses and pillars therebetween.

With reference to FIG. 3, the second midsole platform 40 can be constructed so that the second sidewall 42 and/or the outward extending flange 46 generally forms a secondary perimeter wall 47 around the upper surface 41 of the second midsole platform 40. This secondary perimeter wall 47 can extend upward from the second midsole platform to form a secondary recess 48 above the second upper surface 41. The first midsole platform 30 can be positioned with its generally flat planar first lower surface 33 positioned in the secondary recess 48. In some cases, the shoulder 34A of the first midsole platform can abut the secondary perimeter wall 47 so as to register that first midsole platform with the second midsole platform. Optionally, the lower surface 33 can be welded, glued, cemented, fastened, molded or otherwise secured within the secondary recess, generally to the second upper surface 41 of the second midsole platform 40, and in particular, portions of the pillar walls described below.

As mentioned above, the second midsole platform can be constructed from a second material, different from the first material, and generally softer than the first material so that the first midsole platform and second midsole platform can synergistically cooperate with one another to provide a midsole having both cushioning and rigidity features as well as enhancing impact absorption and traction. In particular, the second material can be constructed from EVA, PU, latex, foam, a gel or other materials. As shown, the second midsole platform 40 can be constructed from EVA to provide a soft cushion and impact absorption. This platform can have a second durometer of optionally about 35 Asker C to about 45 Asker C, inclusive; further optionally about 30 Asker C to about 47 Asker C, inclusive; or even further optionally about 40 Asker C.

Optionally, the second midsole platform 40 can be constructed to include an array of recesses 60. These recesses can be defined and can extend downwardly from the second upper surface 41. Each of the recesses can be bounded by one or more pillar walls 62 along the sides of the recesses. These pillar walls can extend upward to an upper or uppermost surface 62U of a respective pillar wall. This upper surface of the pillar wall can lay generally in the same plane as the upper surface 41 of the second midsole platform 40. The pillar walls 62 can outline a lattice like array of the recesses. As shown, the recesses optionally can be polygonal in shape, for example, generally diamond shaped with pillar walls intersecting one another in a range of about 45° to 90°, inclusive. Of course, the pillar walls can form other shapes for the recesses. The pillar walls can extend downward along sides of the recesses to a bottom wall 65 of the recesses. The bottom walls 65 of the recesses can extend optionally greater than 0.5 mm, further optionally greater than 1.0 mm, yet further optionally greater than 2.0 mm, yet further optionally greater than 4.0 mm below the second upper surface, as well as the first lower surface of the respective platforms. The bottom wall 65 of each of the recesses can be disposed generally below the level at which the uppermost surface 52 of the upper edge 52U of the outsole upstanding cup wall 52.

As mentioned above, the sole assembly 20 can include a separately constructed outsole 50 that is joined with the midsole, in particular the second midsole platform 40, under that component. The outsole 50 can be the lowermost part of the sole assembly 20. The outsole 50 can include multiple lugs 54 and/or treads that extend downward, or alternatively can be relatively featureless, forming a smooth surface. Where present, the lugs and treads can be arranged as desired, and alternatively in a repeating pattern. The lugs and treads can include one or more geometric shapes. The outsole tread can be constructed from one or more materials, for example, natural or synthetic rubber, thermoplastic polyurethane elastomers (TPU), nylon, polymer blends, wear resistant polymers, elastomers and/or other materials. Other materials, such as fiber-reinforced polymers can be used, which can include epoxy, polyethylene or thermosetting plastic reinforced with carbon, glass and/or aramid fibers for enhanced protection. The outsole material can have a durometer, optionally about 40 Shore A to about 70 Shore A, further optionally about 68 Shore A to 72 Shore A.

The outsole 50 can include an outsole base 57 with which the lugs 54 are integrally formed and extend outwardly therefrom. The outsole base 57 can include an outsole upper surface 51 and an outsole lower surface 53, opposite the upper surface. Between the upper surface and lower surface, the outsole base has a thickness selected so that the outsole base is generally flexible. For example, the outsole base can be of a substantially uniform thickness of optionally 0.5 mm to 4.0 mm, inclusive; further optionally 0.5 to 2.5 mm, inclusive; yet further optionally about 1.0 mm, under the second lower surface 43 of the second midsole platform. With this thin outsole base, the outsole can be configured to flex and deflect upwardly when one or more of the lugs 54 engage an underfoot terrain feature as described below. The lugs 54 can be a greater thickness than that of the outsole base, and can extend outwardly from the lower surface of that outsole base a preselected distance, depending on the functionality of the footwear.

The various lugs 54 of the outsole can be placed in different locations on the lower surface of the outsole base, generally under the outsole. For example, some of the lugs 54A can be aligned with respective ones of the recesses 60A, while other lugs 54B can be aligned with respective ones of the pillar walls 62B. Generally the lug 54A can lay under a portion of the recess 60A and optionally directly under the bottom wall 65A of that recess. The other lug 54B can lay directly under the a pillar wall 62B without substantially overlapping the adjacent recesses 60B1 and 60B2 and their respective bottom walls 65B. Of course, in some constructions, all of the lugs can be aligned with respective pillar walls above them, and/or all of the lugs can be aligned with the respective recesses directly above them. In other cases, some lugs can overlap a portion of a pillar wall and a portion of the recess or the bottom wall of a recess or multiple recesses, depending on the size of the lug, the size of the recesses and/or the size of the pillar walls. For example, in some cases, certain lugs, such as lug 54C optionally can overlap a respective recess 60C as well as a pillar wall 62C disposed above that lug 54C. This can provide a slightly different cushioning and traction response than the second lugs as described above.

Figure 6:
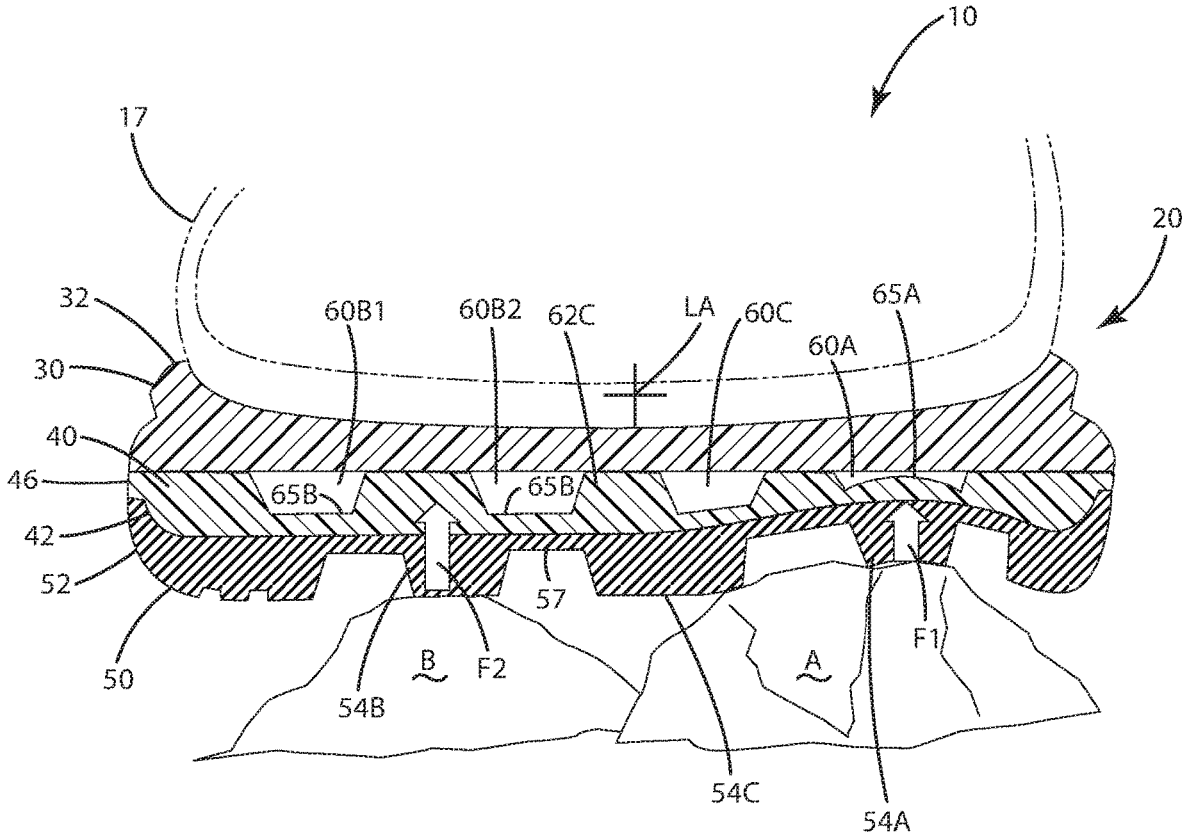
FIG. 6 is a cross section of the sole assembly of the footwear along line IV-IV of FIG. 1 illustrating a lug being absorbed upward into the second midsole platform upon engagement of the lug with an underfoot terrain feature to provide enhanced traction and cushioning.

The alignment of the lugs with the recesses of the pillar walls can provide different responses, thereby enabling the sole assembly to provide normal response cushioning or softer cushioning plus enhanced traction. For example, when the footwear 10, and particularly the sole assembly 20 engages underfoot feature features A and/or B, as shown in FIG. 6, different responses can be output. As shown to the lower right of FIG. 6, the underfoot terrain feature A engages the lug 54A. In turn, the underfoot feature A transmits a force F1 to the lug 54A, and this force F1 is transmitted to the outsole and to the second midsole platform. Due to the alignment of the lug 54A with the recess 60A, as well optionally as the flexibility of the outsole base and the soft durometer of the second midsole platform 40, that lug 54A can collapse upwardly as shown, into the respective recess 60A. The bottom wall 65A of the recess 60A also can deform and deflect upward, generally bowing upward as shown in FIG. 6, due to the force F1. As a result, the underfoot terrain feature A is absorbed at least partially by the second midsole platform and the midsole in general, with the lugs interfacing with that second midsole platform. In turn, this can enhance the traction of the respective lugs, the sole assembly and the footwear in general relative to the underfoot terrain feature. It also can enhance the cushioning relative to the underfoot terrain feature due to the absorption of that feature.

Of course, where the second type of lugs 54B are aligned with a pillar wall 62B above that lug, a more normal cushion response and traction response is realized. For example, when the terrain feature B engages the second lug 54B, it transfers the force F2 to that lug. This force F2 is transferred generally upward through the lug and outsole, into the second midsole platform 40. The force F2 transfers upward through the second pillar 62B. The second pillar 62B pushes upward and further engages the first midsole platform, which is constructed from a harder, higher durometer material. As a result, the pillar may deform slightly, but does not deform too much. Likewise, the adjacent recesses 60B1 and 60B2 and their respective bottoms do not deform significantly. As a result, the lug 54B does not retract and is not absorbed upward into the sole assembly to the same degree as the other lug 54A, which is aligned with the recess above it, is absorbed. Instead, the lug 54B is compressed between the underfoot terrain feature B and the pillar wall 62B above that lug upon engagement with the underfoot terrain feature B. As noted above, depending on the underfoot terrain features likely to be encountered by the footwear, the lugs on the outsole can be specifically sized and located relative to the recesses and pillar walls to elicit desired feedback, cushioning and traction.

The outsole 50 can be configured to cooperate with the second midsole platform, and optionally conceal it from the environment to thereby protect it from abrasion where. The outsole also can control lateral movement and expansion of the optionally softer material from which the second midsole platform 40 is constructed. For example, the outsole 50 can include an outsole upstanding cup wall 52 as described above. This upstanding cup wall 52 can extend upward adjacent the second sidewall 42 and can conceal it a portion of it, while leaving another portion slightly above the cup wall exposed to the environment. In some cases, the outsole upper surface 51, shown in FIG. 4, extends upward and transitions to the outsole upstanding cup wall 52. Again, this outsole upstanding couple can extend upward along a first portion of the second sidewall 42A to conceal the first portion of the second sidewall prevent the first portion 42A from being abraded and damaged. The outsole upstanding cup wall 52 can terminate short of a second portion 42B of the second sidewall. This second portion can optionally be the outward extending flange 46. The second portion can be exposed the environment between the first upstanding cup wall in the outsole of standing cup wall.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A footwear construction comprising:

a first midsole platform including a first upper surface bounded at least partially by a first upstanding midsole sidewall extending around a perimeter of the first midsole platform and approximating a shape of a wearer's foot, the first midsole platform constructed from a first material having a first durometer, the first midsole platform having a first lower surface that transitions to the first upstanding midsole sidewall, the first upstanding midsole sidewall being exposed to the environment;

a second midsole platform disposed below the first midsole platform and including a second sidewall that is exposed to the environment below the first sidewall, the second midsole platform constructed from a second material, different from the first material, and having a second durometer less than the first durometer, the second midsole platform having a second upper surface defining a plurality of recesses arranged in an array, each of the recesses bounded by at least one pillar wall, with an uppermost surface of the at least one pillar wall bonded to the lower surface of the first midsole platform, and at least one recess bottom wall, the at least one recess bottom wall disposed greater than 1.0 mm below the first lower surface, the second midsole platform including a second lower surface transitioning to the second sidewall at a second radiused corner; and an outsole disposed below the second midsole platform, the outsole including an outsole base and outsole upper surface that transitions to an outsole upstanding cup wall that is joined with the second radiused corner of the second sidewall and extends upwardly to conceal the second radiused corner from the environment while leaving a portion of the second sidewall exposed between the first upstanding midsole sidewall and the outsole upstanding cup wall, the outsole including a first plurality of lugs aligned with the respective ones of the plurality of recesses and a second plurality of lugs aligned with respective ones of the at least one pillar wall; and an upper joined above the first midsole platform, wherein the outsole base is flexible so that the first plurality of lugs move upwardly toward a respective recess of the plurality of recesses when the first plurality of lugs engage an underfoot terrain feature, wherein the second plurality of lugs are compressed between the underfoot terrain feature and the at least one pillar wall above a respective lug of the second plurality of lugs when the second plurality of lugs engage the underfoot terrain feature, whereby the underfoot terrain feature is absorbed at least partially via the first and second plurality of lugs interfacing with the second midsole platform to thereby enhance traction of the footwear, wherein the first and second midsole platforms comprise a midsole sidewall height, the first upstanding midsole sidewall comprises an exterior portion that is exposed to the environment for a majority of the midsole sidewall height and the portion of the second sidewall that is exposed between the first upstanding midsole sidewall and the outsole upstanding cup wall is exposed to the environment for a minority of the midsole sidewall height wherein the outsole upstanding cup wall extends to conceal a majority of the second sidewall.

2. The footwear construction of claim 1, wherein a first lug of the first plurality of lugs overlaps a first recess of the plurality of recesses and a first pillar wall of the at least one pillar wall disposed above the first lug.

3. The footwear construction of claim 1, wherein the outsole base is joined with the second lower surface of the second midsole platform, the outsole base having a thickness of 0.5 mm to 3.0 mm, inclusive, under the second lower surface of the second midsole platform, wherein the outsole base is configured to flex and deflect upward when the first plurality of lugs engages the underfoot terrain feature.

4. The footwear construction of claim 1, wherein the plurality of recesses are a plurality of polygonal shaped recesses.

5. The footwear construction of claim 4, wherein the second sidewall of the second midsole platform includes an outward extending flange, wherein the outsole upstanding cup wall includes an upper edge, wherein the outward extending flange extends adjacent and over the upper edge, away from a longitudinal axis of the second midsole platform, wherein the outward extending flange is the portion of the second sidewall exposed between the first upstanding midsole sidewall and the outsole upstanding cup wall.

6. The footwear construction of claim 5, wherein the second radiused corner is disposed below the outward extending flange.

7. The footwear construction of claim 1, wherein the second midsole platform includes a secondary perimeter wall that extends upward from the second midsole platform to form a secondary recess above the plurality of recesses and the at least one pillar wall, wherein the first midsole platform is positioned with the first lower surface in the secondary recess.

8. The footwear construction of claim 7, wherein the second sidewall of the second midsole platform includes an outward extending flange, wherein the outward extending flange is disposed at least partially above the secondary recess.

9. The footwear construction of claim 1, wherein the first upstanding midsole sidewall extends upward along the at least a portion of the upper to conceal the portion of the upper.

10. The footwear construction of claim 9, wherein the plurality of recesses are polygonal recesses disposed in a lattice array.

11. A footwear construction comprising:

a first midsole platform constructed from a first material having a first durometer, the first midsole platform including a first upward extending cup wall that extends upward from a first upper surface, the first midsole platform including a first lower surface opposite the first upper surface;

a second midsole platform constructed of a second material having a second durometer, less than the first durometer, so that the second midsole platform is softer than the first midsole platform, the second midsole platform having a second sidewall that transitions between a second upper surface and a second lower surface, the second upper surface defining a plurality of recesses arranged in an array, the array including a plurality of pillar walls with upper pillar surfaces bonded to the first lower surface;

an outsole disposed below the second lower surface, the outsole including an outsole upper surface that transitions to an outsole upstanding cup wall that extends upward along a first portion of the second sidewall, which constitutes a majority of the second sidewall, to conceal the first portion of the second sidewall and prevent the first portion from being abraded and damaged, the outsole upstanding cup wall terminating short of a second portion of the second sidewall, which constitutes a minority of the second sidewall, so the second portion is exposed to the environment between the first upward extending cup wall and the outsole upstanding cup wall, the outsole including a plurality of lugs extending downward from an outsole lower surface; and an upper joined with at least one of the first midsole platform and the second midsole platform, whereby an underfoot terrain feature is configured to be absorbed at least partially via the plurality of lugs interfacing with the second midsole platform to thereby enhance traction of the footwear, wherein the outsole upstanding cup wall extends to conceal the majority of the second sidewall.

12. The footwear construction of claim 11, wherein the first durometer is 50-60 Asker C, inclusive, wherein the second durometer is 35-45 Asker C, inclusive.

13. The footwear construction of claim 12, wherein the outsole upstanding cup wall surrounds the second sidewall of the second midsole platform so as to control a lateral and expansive movement of the second material when a lug of the plurality of lugs is pushed upward toward the second material due to the lug's engagement with the underfoot terrain feature.

14. The footwear construction of claim 13, wherein the plurality of recesses are polygonal recesses disposed in a lattice array.

15. The footwear construction of claim 14, wherein the second sidewall of the second midsole platform includes an outward extending flange, wherein the outsole upstanding cup wall includes an upper edge, wherein the outward extending flange extends adjacent and over the upper edge, wherein the outward extending flange is the second portion of the second sidewall exposed between the first upward extending cup wall and the outsole upstanding cup wall.

16. The footwear construction of claim 13, wherein a first lug of the plurality of lugs is aligned with a respective recess of the plurality of recesses, wherein a second lug of the plurality of lugs is aligned with a respective pillar wall of the plurality of pillar walls.

17. The footwear construction of claim 16, wherein the outsole is configured so that the first lug moves upwardly toward the respective recess when the first lug engages the underfoot terrain feature, wherein the second lug is compressed between the underfoot terrain feature and the at least one pillar wall above a respective lug of the plurality of lugs when the plurality of lugs engage the underfoot terrain feature.

18. A footwear construction comprising:

an upper;

a first midsole platform below the upper, the first midsole platform having a first durometer of 50-60 Asker C, inclusive, the first midsole platform including a first upward extending cup wall that extends upward from a first upper surface to conceal a lower portion of the upper, the first midsole platform including a first lower surface opposite the first upper surface;

a second midsole platform having a durometer of 35-45 Asker C, inclusive, so that the second midsole platform is softer than the first midsole platform, the second midsole platform having a second sidewall that transitions between a second upper surface and a second lower surface;

an outsole disposed below the second lower surface, the outsole including an outsole upper surface that transitions to an outsole upstanding cup wall that extends upward along a first portion of the second sidewall that defines a majority of the second sidewall to conceal the majority of the second sidewall and prevent the first portion from being abraded and damaged, the outsole upstanding cup wall terminating short of a second portion of the second sidewall that defines a minority of the second sidewall so the minority of the second sidewall is exposed to the environment between the first upward extending cup wall and the outsole upstanding cup wall, the outsole including a plurality of lugs extending downward from an outsole lower surface, wherein the outsole upstanding cup wall surrounds the second sidewall of the second midsole platform so as to control a lateral and expansive movement of the second midsole platform when a lug of the plurality of lugs is pushed upward toward the second midsole platform due to the lug's engagement with an underfoot terrain feature, whereby the underfoot terrain feature is configured to be absorbed at least partially via the plurality of lugs interfacing with the second midsole platform to thereby enhance traction of the footwear, wherein the first and second midsole platforms comprise a midsole height, the first upward extending cup wall comprises an exterior portion that is exposed to the environment for a majority of the midsole height and the second portion of the second sidewall is exposed to the environment for a minority of the midsole height.

19. The footwear construction of claim 18, wherein the second sidewall of the second midsole platform includes an outward extending flange, wherein the outsole upstanding cup wall includes an upper edge, wherein the outward extending flange extends adjacent and over the upper edge, wherein the outward extending flange is the second portion of the second sidewall exposed between the first upward extending cup wall and the outsole upstanding cup wall.

20. The footwear construction of claim 18, wherein the second upper surface defines a plurality of recesses arranged in an array, the array including a plurality of pillar walls with upper pillar surfaces bonded to the first lower surface of the first midsole platform.

* * * * *